United States Patent [19]

Frear

[11] 4,395,083

[45] Jul. 26, 1983

[54] ELECTRICAL CONNECTOR HAVING REMOVABLE CONTACTS

[75] Inventor: David L. Frear, Afton, N.Y.

[73] Assignee: The Bendix Corporation, Southfield, Mich.

[21] Appl. No.: 279,147

[22] Filed: Jun. 30, 1981

[51] Int. Cl.[3] ..... H01R 13/42

[52] U.S. Cl. ..... 339/59 R

[58] Field of Search ..... 339/59 R, 59 M, 217 S

[56] References Cited

U.S. PATENT DOCUMENTS

| | | | |
|---|---|---|---|
| 3,158,424 | 11/1964 | Bowen . | |
| 3,165,369 | 1/1965 | Maston . | |
| 3,221,292 | 11/1965 | Swanson et al. . | |
| 3,368,185 | 2/1968 | Dell et al. | 339/217 S |
| 3,747,047 | 7/1973 | Carter et al. | 339/59 M X |
| 3,813,636 | 5/1934 | Mason | 339/59 R |
| 3,824,681 | 7/1974 | Clark | 339/90 C |
| 4,082,398 | 4/1978 | Bourdon et al. | 339/59 M |

FOREIGN PATENT DOCUMENTS

| | | | |
|---|---|---|---|
| 2445633 | 8/1980 | France | 339/59 R |
| 2073505 | 10/1981 | United Kingdom | 339/59 R |

*Primary Examiner*—Mark Rosenbaum

*Attorney, Agent, or Firm*—Raymond J. Eifler

[57] ABSTRACT

The invention is an electrical connector assembly of the type having a housing (50); a rubber moisture sealing grommet (20) and a contact retaining insert (10) characterized by a plurality of passages (15) that contain a plurality of pivotally mounted (13) and radially deflectable arcuate segments (11) that include on the inside thereof a radially inward projecting and radially tapered shoulder (12) that engages a groove (32) of a contact (30) located in a passage (15). A tool (60) may be inserted into the passage to pivot the arcuate segments (11) outwardly so that the shoulders (12) disengage the groove (32) in the contact (30) thereby releasing the contact (30) for removal from the passage (15).

10 Claims, 7 Drawing Figures

FIG. 1
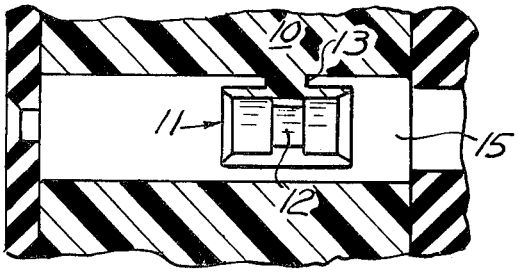
FIG. 2
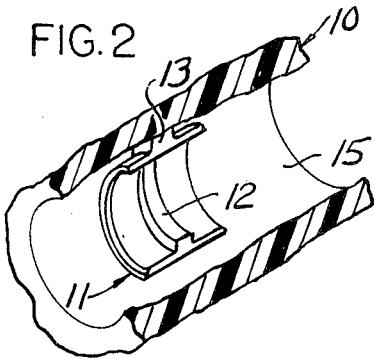
FIG. 3
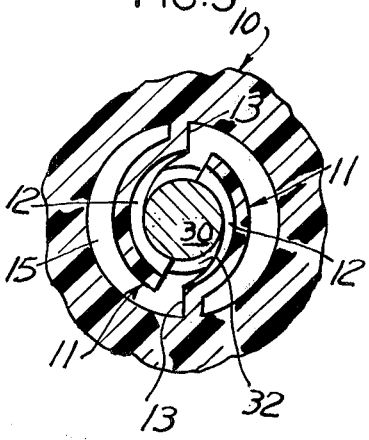
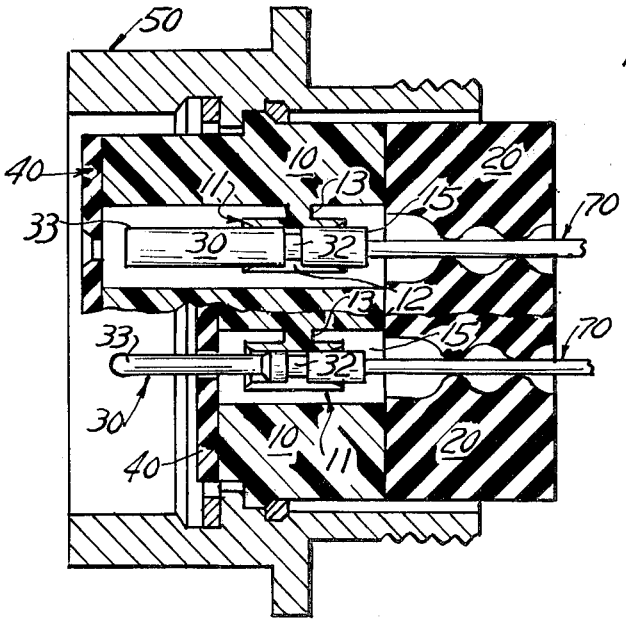
FIG. 4

ELECTRICAL CONNECTOR HAVING REMOVABLE CONTACTS

This invention relates to electrical connectors having front or rear releasable and front or rear removable contacts and more particularly to the contact retaining mechanism within the connector.

Electrical connectors generally include a plug and a receptacle, each of which has an insert of dielectric material provided with multiple openings within which electrical contacts are releasably retained. Examples of electrical connectors that have rear releasable and rear removable contacts may be found in U.S. Pat. Nos. 3,165,369 issued Jan. 12, 1965 and entitled, "Retention System for Electrical Contacts"; 3,158,424 issued Nov. 24, 1964 and entitled, "Contact Mounting"; and U.S. Pat. No. 3,824,681 issued July 23, 1974 and entitled, "Method of Providing a Coupling for Electrical Connectors and the Like". Connectors of this type allow contacts to be removed from the rear of a connector while it is still connected to another connector. An example of another type of electrical connector that has front releasable and front removable contacts as well as rear releasable and rear removable contacts may be found in U.S. Pat. No. 4,082,398 issued Apr. 4, 1978 and entitled, "Electrical Connector with Front and Rear Insertable and Removable Contacts". Finally, an example of an electrical connector of the type having front releasable and rear removable contacts may be found in U.S. Pat. No. 3,221,292 issued Nov. 30, 1960 and entitled, "Electrical Connector".

None of the foregoing connectors provide a connector that permits front or rear release of a contact that can be removed from either the rear or front of a connector.

DISCLOSURE OF THE INVENTION

This invention provides an electrical connector having removable contacts that may be released from either the front or the rear of the connector for removal from either the front or rear of the connector.

The invention is an electrical connector of the type having a housing, a plurality of contacts, and means for removably mounting the contacts in the housing characterized by an insert having a plurality of passages each of which contains two pivotally mounted arcuate segments each having an inwardly projecting and radially tapered shoulder that engages a groove in the middle portion of a respective contact. By pivoting the arcuate segments outwardly with a tool the contact is released for removal from the insert.

One advantage of this invention is that it provides the option of releasing and removing a contact from either the front or the rear of a connector.

Another advantage is that the radially tapered contact retaining shoulder is easily releasable while securely retaining the contacts.

DETAILED DESCRIPTION OF THE INVENTION

FIG. 1 is a side view of a portion of a contact retaining insert incorporating the principles of this invention.

FIG. 2 is a perspective view of the insert shown in FIG. 1.

FIG. 3 is a cut away view of the insert shown in FIG. 1.

FIG. 4 illustrates an electrical connector incorporating the principles of this invention.

Figure 5:
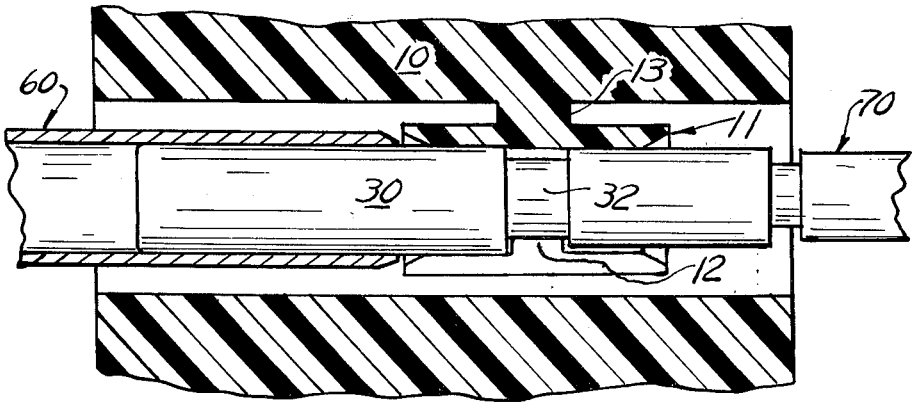
FIGS. 5 and 6 illustrates how a contact is released from one end of the insert for removal from the insert.

Referring now to the drawing, FIG. 1 is a partial view of an insert 10 illustrating one of a plurality of passages 15 therein each of which contain two arcuate segments 11 (only one shown) for releasably retaining a contact (not shown). The insert 10 and the arcuate segments 11 are a one-piece body molded from a dielectric material e.g., a polyamide such as Torlon. Each arcuate segment 11 includes an internal radially tapered shoulder 12 which projects inwardly. The arcuate segments 11 being integrally connected to the wall of the passageway 15 in the insert 10 by a connecting member 13 which allows the arcuate segments 11 to pivot radially outward. The inwardly projecting shoulder 12 is aligned with the connecting member 13.

FIG. 2 illustrates how the radial thickness of the shoulder 12 increases as the distance from the connecting member 13 increases. This arrangement permits quick release of a contact (not shown) when the shoulder 12 is deflected or partially rotated outwardly.

FIG. 3 is a cut away view of the two arcuate segments in the passage 15 of the insert 10. This view illustrates the configuration of the member 13 connecting the arcuate segments 11 to the main body of the insert 10. The connecting member 13 permits the radially tapered shoulder 12 to pivot outwardly, moving further outwardly at the free end than the opposite end. The radial thickness of the shoulder 12 being greatest at the free end to assure retention and easy release of the contact 30.

FIG. 4 illustrates a diagrammatic view of an electrical connector having male and female contacts 30 mounted therein that have a wire 70 attached thereto. The electrical connector is generally comprised of an outer metal shell 50; a contact retaining insert 10 mounted within the connector shell 50; a rear moisture sealing grommet 20; and a forward interfacial seal 40 generally comprised of rubber.

FIG. 5 illustrates the first step in releasing a contact 30 for removal from either end of the insert 10 by inserting a tool 60 into one end of the insert 10.

Figure 6:
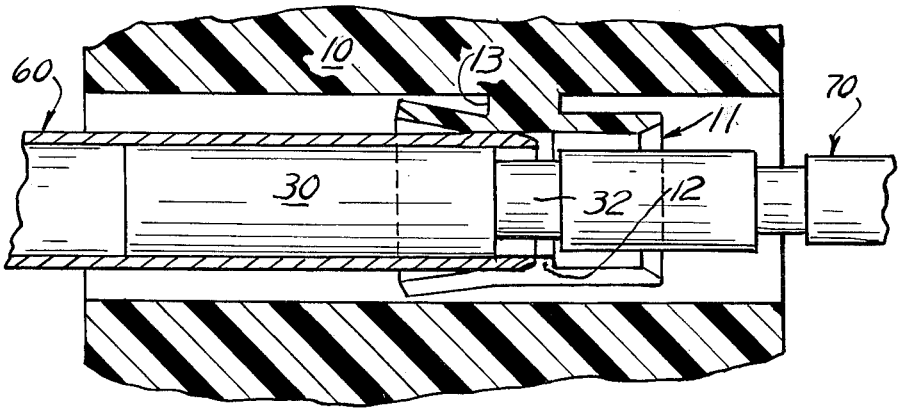

FIG. 6 illustrates the second step in releasing a contact 30 for removal from either end of the insert 10 wherein the tool 60 has deflected the arcuate segments 11 outwardly so that the contact 30 may be removed from either end of the insert 10 by pulling or pushing on the wire 70. Once the tool 60 is removed the deflected segments 11 return to their original position.

Figure 7:
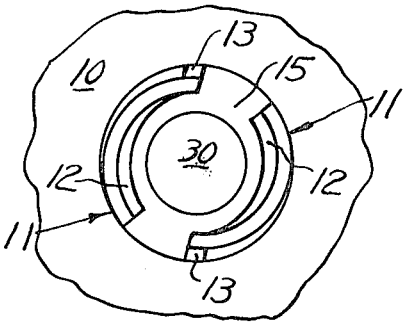
FIG. 7 is an end view of the insert and the released contact shown in FIG. 6.

FIG. 7 is a cross section of a passage 15 in the insert 10 which illustrates the tapered shoulders 12 disengaged from the groove in the contact 30 by the tool 60 (not shown).

While a preferred embodiment of the invention has been disclosed, it will be apparent to those skilled in the art that changes may be made to the invention as set forth in the appended claims, and in some instances, certain features of the invention may be used to advantage without corresponding use of other features. For instance, the number of arcuate segments for retaining a contact within the insert could be changed. Accordingly, it is intended that the illustrative and descriptive materials herein be used to illustrate the principles of the invention and not to limit the scope thereof.

Having described the invention what is claimed is:

1. In combination with an electrical connector having removable contacts said connector of the type having: a housing; a plurality of contacts, each contact having a rear portion, a forward mating portion, and an annular groove between said forward and rear portions, and means for releasably mounting said contacts in said housing including an insert having a plurality of bores therein, each bore having therein a portion of a respective contact having the annular groove therein and a contact retention member, the improvement wherein said contact retention member comprises:

an arcuate segment having forward and rear ends, axially extending sides between said ends, one of said sides being radially deflectable, on the inside of said segment an inwardly projecting and radially tapered arcuate shoulder engaging the annular groove in a respective contact, said shoulder extending radially inward a greater distance at said deflectable side of said segment than at said other side, and on the outside of said segment, means, located adjacent said other side of said segment and between said ends thereof, for pivotally mounting to said insert the arcuate segment in each bore so that an axial side of said arcuate segment may be deflected radially outwardly to disengage the projecting shoulder from the groove in the contact whereby, a tool may be inserted into a bore in said insert to engage and pivot an axial side of said arcuate segment radially outwardly in said bore so that the projecting shoulder of said segment disengages from the groove in the contact thereby releasing the contact in said bore for removal from the connector.

2. The electrical connector recited in claim 1 wherein said means for pivotally mounting said segment is a radially extending connecting member integral at one end with the outside of a portion of said arcuate segment and integral at the other end of said member with the wall of the bore in the insert.

3. The electrical connector recited in claim 1 wherein said means for pivotally mounting each of said contact retention members is a radially extending connecting member integral at one end with the outside of a portion of said arcuate segment and integral at the other end of said member with the wall of the bore in the insert.

4. The connector as recited in claim 1 wherein there are at least two segments in each bore.

5. In combination with an electrical connector having removable contacts, said connector of the type having a housing; a plurality of contacts, each contact having a rear portion, a forward mating portion, and an annular groove between said forward and rear portions; an insert having a plurality of bores each having a rear portion of a respective contact therein; and means for releasably mounting said contacts in a respective bore, said means including a plurality of contact retaining members in each of said bores, the improvement wherein each of said contact retaining members comprises:

an arcuate segment having forward and rear ends spaced from the wall of said bore, axial extending sides between said ends, one of said sides being radially deflectable, on the inside of said segment an inwardly projecting and radially tapered arcuate shoulder engaging the annular groove in a contact in the bore, and on the outside means located between the ends thereof for pivotally mounting an axial side of said arcuate segment in each bore of said insert whereby, a tool may be inserted into a bore in said insert to engage and pivot said arcuate segment in said bore thereby releasing a contact in said bore for removal from the connector.

6. The electrical connector recited in claim 5 wherein the radial thickness of said shoulder increases as the distance from said connecting member increases.

7. The electrical connector recited in claim 6 wherein the radial thickness of said shoulder increases as the distance from said connecting member increases.

8. In combination with an electrical connector having removable contacts said connector of the type having: a housing; a plurality of contacts, each contact having a rear portion, a forward mating portion, and an annular groove between said forward and rear portions, and means for releasably mounting said contacts in said housing including an insert having a plurality of bores therein, each bore having therein a portion of a respective contact having the annular groove therein and a plurality of contact retention members in each bore, the improvement wherein:

each of said retention members includes forward and rear ends spaced from the wall of said bore, axially extending sides between said ends, one of said sides being radially deflectable, an inwardly projecting and radially tapered arcuate shoulder engaging the annular groove in a respective contact; and means located between the ends of said retention members for pivotally mounting said contact retention members in a respective bore of said insert whereby, a tool may be inserted into a bore to engage and pivot said members thereby releasing a contact in the bore for removal from the connector.

9. The electrical connector recited in claim 8 wherein the radial thickness of said shoulder decreases as the distance from said deflectable side increases.

10. In combination with an electrical connector having removable contacts said connector of the type having: a housing; a plurality of contacts, each contact having a rear portion, a forward mating portion, and means for releasably mounting said contacts in said housing including an insert having a plurality of bores therein, each bore having therein a portion of a respective contact therein and a plurality of contact retention members in each bore, the improvement wherein:

each of said retention members includes forward and rear ends spaced from the wall of said bore and axially extending sides between said ends;

an arcuate groove in each one of said contacts and said retention members;

a radially tapered arcuate shoulder in each one of the other of said contacts and retention members engaging a respective arcuate groove; and means located between the ends of said retention members for pivotally mounting said contact retention members in a respective bore of said insert so that one axial side of each member is radially deflectable to disengage the shoulder from a respective groove whereby, a tool may be inserted into a bore to engage and pivot said members thereby releasing a contact in the bore for removal from the connector.

* * * * *